US006276030B1

(12) United States Patent
Smith

(10) Patent No.: US 6,276,030 B1
(45) Date of Patent: Aug. 21, 2001

(54) RETRACTABLE SAFETY MECHANISM AND A PIN OR COMPASS INCORPORATING SAME

(75) Inventor: Paul A. Smith, Glenview, IL (US)

(73) Assignee: Eversharp Pen Company, Franklin Park, IL (US)

( * ) Notice: Subject to any disclaimer, the term of this patent is extended or adjusted under 35 U.S.C. 154(b) by 0 days.

(21) Appl. No.: 09/183,064

(22) Filed: Oct. 30, 1998

(51) Int. Cl.[7] ..... A44B 9/10
(52) U.S. Cl. ..... 24/115 G; 24/710.4
(58) Field of Search ..... 33/27.02, 27.031, 33/27.01, 18.1, 18.2, 32.1; 24/115 G, 136 L, 115 N, 710.4

(56) References Cited

U.S. PATENT DOCUMENTS

| | | | | |
|---|---|---|---|---|
| 375,257 | | 12/1887 | Boman | 33/27.02 |
| 710,242 | | 9/1902 | Bossart-Bächli | 33/558.01 |
| 729,717 | | 6/1903 | Beasley | 33/27.02 |
| 1,028,228 | | 6/1912 | Lampel | 33/27.02 |
| 1,070,264 | * | 8/1913 | Kokernot | 24/710.4 |
| 1,070,265 | * | 8/1913 | Kokernot | 24/710.4 |
| 1,127,346 | | 2/1915 | Bacon | 24/710.4 |
| 1,203,330 | | 10/1916 | Hecker | 24/710.4 |
| 1,275,088 | | 8/1918 | Ramos | 24/710.4 |
| 1,769,477 | | 7/1930 | Thompson | 24/710.2 |
| 1,857,158 | | 5/1932 | Maloney | 248/685 |
| 2,041,299 | | 5/1936 | Neumayer | 33/27.02 |
| 2,320,603 | * | 6/1943 | Ivy | 33/27.12 |
| 2,518,977 | | 8/1950 | Conway | 24/710.4 |
| 2,573,760 | * | 11/1951 | Cherne | 33/27.02 |
| 2,637,906 | | 5/1953 | Giossi | 33/27.02 |
| 2,764,816 | * | 10/1956 | De Cesaris | 33/27.02 |
| 3,104,466 | * | 9/1963 | King | 33/27.02 |
| 3,308,538 | | 3/1967 | Peck | 33/27.02 |
| 3,550,282 | | 12/1970 | Tsunemi | 33/27.02 |
| 3,687,562 | * | 8/1972 | Basham | 401/230 |
| 3,797,119 | * | 3/1974 | McDow | 33/27.09 |
| 3,955,462 | | 5/1976 | Thorsman | 411/439 |
| 4,005,507 | | 2/1977 | Yamazaki | 24/351 |
| 4,453,292 | * | 6/1984 | Bakker | 24/115 G |
| 4,561,184 | | 12/1985 | Fujitani | 33/27.02 |
| 4,711,592 | * | 12/1987 | Gregory | 401/107 |
| 4,815,881 | | 3/1989 | Chern | 401/52 |
| 5,546,664 | * | 8/1996 | Kuo | 33/30.3 |
| 6,038,746 | * | 3/2000 | Anscher et al. | 24/115 G |

* cited by examiner

*Primary Examiner*—G. Bradley Bennett
(74) *Attorney, Agent, or Firm*—Patents+TMS

(57) ABSTRACT

A retractable sleeve for a push pin or compass is provided creating a safety mechanism for the device on which it is used. The sleeve preferably incorporates a spring such that the sleeve is maintained in a position to encase a point of the device and safely prevent accidental sticking from the pointed end. The sleeve may also incorporate a groove for alignment purposes and ease of use. The groove may also have a perpendicularly extending portion in which a button from the device on which the sleeve is used may engage to maintain the same in a tense position. The sleeve may be incorporated, for example, for use with a push button or a compass or other like mechanism for which safety issues are a concern.

11 Claims, 1 Drawing Sheet

RETRACTABLE SAFETY MECHANISM AND A PIN OR COMPASS INCORPORATING SAME

BACKGROUND OF THE INVENTION

The present invention generally relates to a protection mechanism for an object having a sharp or pointed end. More specifically, the present invention relates to a retractable safety mechanism for use with an object having a sharp or pointed end, such as a pin or a compass.

It is, of course, generally known to provide pins for use on bulletin boards or the like for posting notes or signs, for example. Often, the pin dislodges from the surface to which the pin is attached and lays on the floor, for example, making the same dangerous if stepped on or if otherwise stuck by the pin.

In addition, pins and compasses are often utilized in classroom settings where children, for example, may be rather careless in their use. Such usage often creates dangerous conditions for other children or individuals who might be stuck by the pin or compass if the same was encountered. Safety push pins are also known and described in, for example, U.S. Pat. No. 4,005,507 to Yamazaki. The push pin disclosed and described in Yamazaki is a two-piece construction having an upper shell with a large diameter hole having an inwardly flanged opening edge and a lower shell having a small diameter hole in the center of a bottom wall thereof. The head of the push pin has a diameter larger than the distance across the inwardly flanged edge. The pin extending from the head of the push pin is passable through the small diameter hole. An elastic member may be interposed between the upper and lower shells so that the space is normally open. The push pin disclosed, however, by Yamazaki, is rather complex and is often difficult to manufacture and to use due to its two-piece construction.

A need, therefore, exists for an improved safety push pin and safety compass as well as a retractable safety mechanism usable therewith that overcome the deficiencies of known devices and is simple to manufacture and easy to use.

SUMMARY OF THE INVENTION

The present invention provides a retractable safety mechanism, safety push pin and safety compass that prevents accidental sticking of an individual using the is same or from accidental release or dropping of the same.

To this end, in an embodiment of the present invention, a retractable push pin assembly is provided. The assembly has a pin with a first end and a second end defining a length therebetween. The second end has a pointed tip. An integrally formed sleeve has an interior space secured along the length of the pin such that the sleeve may extend between a first position and a second position wherein the second position encloses the pointed tip in the interior space of the sleeve. A spring in the interior space of the sleeve holds the sleeve in the second position.

In an embodiment, a longitudinal groove extends in a wall of the sleeve from a first end to a point toward a second end of the sleeve.

In an embodiment, a collar is associated with the pin intermediate the first end and the second end wherein the collar is in the interior space of the sleeve.

In an embodiment, an aperture at each end of the sleeve cooperates with the pin.

In an embodiment, a groove extends longitudinally along a length of the sleeve and further includes a portion angularly disposed with respect to the longitudinal portion of the groove.

In an embodiment, a button is associated with the pin that is extendable in the groove of the sleeve.

In an embodiment, first and second grooves are peripherally displaced on the sleeve and extend in parallel and longitudinally along a length of the sleeve.

In another embodiment of the present invention, a compass assembly is provided. The assembly has a first leg and a second leg connected to pivot with respect to each other at an end point wherein the first leg has a marking tip at an end opposite the common end point and a second leg has an engaging tip at an end opposite the common end point wherein the first leg and the second leg are of substantially equal length. A sleeve has an interior space defined by walls of the sleeve slidably attached to the second leg and extendable between a first position and a second position wherein the engaging tip of the second leg is enclosed in the interior space of the sleeve in the second position. A spring in the interior space of the spring holds the sleeve in the second position.

In an embodiment, a groove is formed in the walls of the sleeve. The groove may be longitudinal to a length of the sleeve. The groove may be longitudinal to the length of the sleeve and angularly disposed for a portion thereof.

In an embodiment, a button is attached to the second leg.

In an embodiment, a button is attached to the second leg and extendable in the groove of the sleeve. The button may be depressable.

In another embodiment of the present invention, a retractable sleeve is provided. An integral body has walls defining an interior space between a first end and a second end. A first aperture has a diameter at the first end of the body. A second aperture is smaller than the first aperture at the second end of the body. A spring is provided in the interior space of the body.

In an embodiment, a groove in the walls of the body longitudinally extends between the first end and the second end.

In an embodiment, a groove in the walls of the body longitudinally extends between the first end and the second end and further extends at an angle.

In an embodiment, the body surrounds a point of an instrument.

It is, therefore, an advantage of the present invention to provide a device that prevents unwanted or accidental sticking during non-usage of the device.

Another advantage of the present invention is to provide a device that is simple to manufacture and simple to use and to provide safety during non-usage.

A still further advantage of the present invention is to provide a safety push pin and safety compass that retract simply and without interference from the safety protective mechanism.

Yet another advantage of the present invention to provide a safety push pin that has a retractable shield constructed and designed to prevent unnecessary removal from, for example, a bulletin board or the like.

A still further advantage of the present invention is to provide a protective shield for a safety pin that is constructed and designed to lock in an unprotected state for certain applications of usage.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
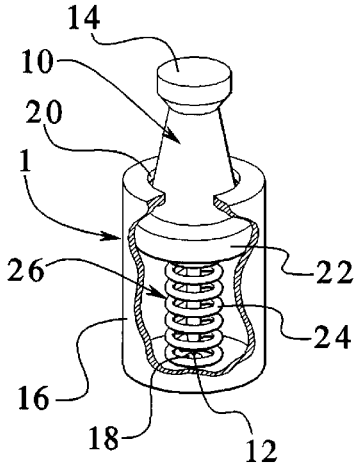
FIG. 1 illustrates a perspective view partially broken-away of an embodiment of a retractable push pin of the present invention.

Referring now to the drawings wherein like numerals refer to like parts, FIG. 1 illustrates a retractable push pin assembly 1. The assembly 1 includes a pin 10 having a pointed end 12 and an opposite end 14 for advancing the pointed end 12 into, for example, a bulletin board or the like. A sleeve 16 is provided to encase the pointed end 12 of the pin 10 when the pin 10 is not in use.

As illustrated, the sleeve 16 includes a first aperture 18 through which the pointed end 12 of the pin 10 extends when advanced through the first aperture 18. A second aperture 20 is provided such that a collar 22 of the pin 10 may be held in the position illustrated in FIG. 1 when the assembly 1 is not in use on, for example, a bulletin board. To this end, a spring 24 is incorporated within an interior space 26 formed by the outer walls of the sleeve 16. The spring 24 in a retracted position as illustrated in FIG. 1 prevents the pointed end 12 of the pin 10 from advancing through the first aperture 18.

Figure 2:
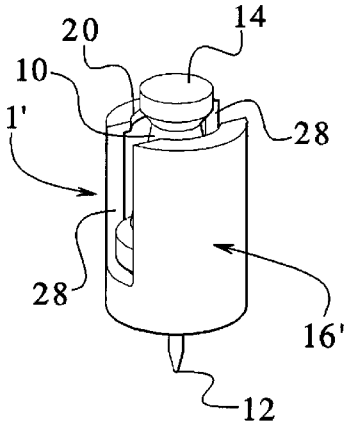
FIG. 2 illustrates a perspective view of an embodiment of a retractable push pin of the present invention.
Figure 3:
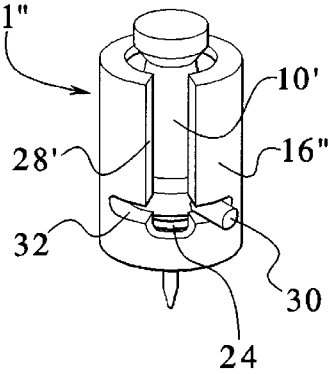
FIG. 3 illustrates a perspective of another embodiment of a retractable push pin of the present invention with a locking feature.

In a second position, as generally illustrated in FIGS. 2 and 3, or other embodiments of the assembly, the pin 10 is advanced such that the pointed end 12 extends through the first aperture of the sleeve 16.

A critical aspect of the present invention is the tensile strength of the spring 24. The tension of the spring 24 must be chosen such that when the push pin assembly 1 is not in use, the spring 24 forces the pin 10 to the position illustrated within the sleeve 16 shown in FIG. 1. Furthermore, the tensile strength of the spring 24 must be selected such that the spring 24 does not force removal of the pin 10 and the assembly 1 from, for example, a bulletin board or other device on which the assembly 1 is used.

Referring now to FIG. 2, another embodiment of a pin assembly 1' is shown. The assembly 1' is identical to the assembly 1 shown and illustrated with reference to FIG. 1 except a sleeve 16' is provided including at least one groove 28 extending longitudinally along the sleeve 16'. The groove 28 extends longitudinally along a length of the sleeve 16' from the aperture 20 to a point intermediate the length of the sleeve 16'. As shown, the groove 28 extends approximately three-quarters of the length of the sleeve 16'. The length of the groove 28 may be varied. Moreover, in a preferred embodiment, two grooves 28 may be incorporated on the sleeve 16' one-hundred eighty degrees apart from each other. The groove 28 or grooves keeps the pin 10 in alignment and reduces friction providing some "give" when the pin 10 advances and retracts within the sleeve 16' of the assembly 1'.

Referring now to FIG. 3, yet another embodiment of an assembly 1" is illustrated. Again, the assembly 1" is identical to the assemblies 1 and 1' shown in FIGS. 1 and 2, respectively. However, the assembly 1" illustrated in FIG. 3 includes a pin 10' having a button 30 extending therefrom. The button 30 is preferably integrally formed with the pin 10" and acts to lock the pin 10' in the advanced position shown and illustrated in FIG. 3.

To this end, a groove 28' similar to the groove 28 in FIG. 2 is provided with one or more perpendicularly extending grooves 32 in which the button 30 may engage and lock the pin 10' in the position illustrated in FIG. 3. One or more perpendicularly extending grooves 32 may be provided as required. In addition, a second groove (not shown) may be provided at another peripheral location on the sleeve 16", preferably one-hundred eighty degrees (180°) displaced from the first groove 28'. Still further, the button 30 may be depressable.

Figure 4:
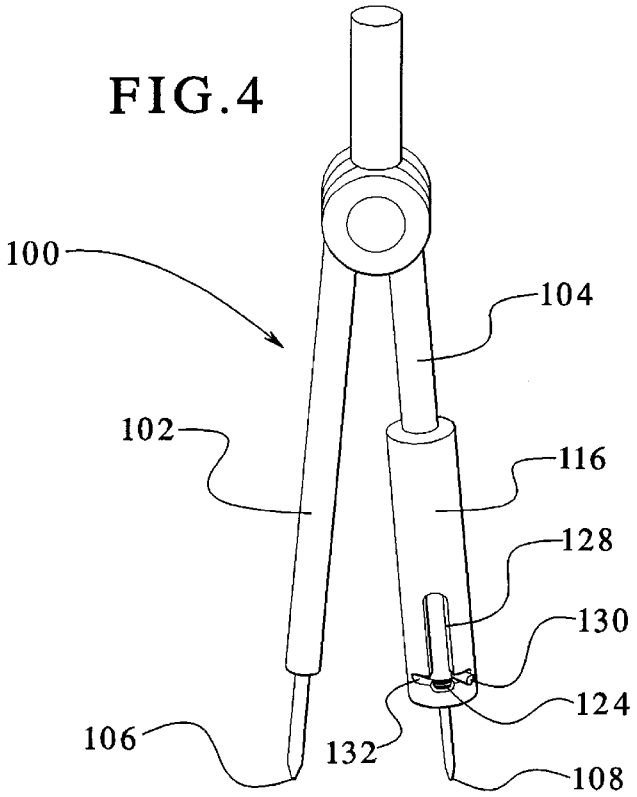
FIG. 4 illustrates a perspective view of an embodiment of a compass with a retractable shield and locking mechanism in an embodiment of the present invention.

Referring now to FIG. 4, another embodiment of a retractable sleeve 116 is shown and illustrated for incorporation and use with a compass 100. The compass 100 is of traditional construction including two legs 102 and 104. The leg 102 includes a marking tip 106, such as, for example, pencil lead or the like. The leg 104 includes a pointed end 108 which, for example, may be firmly held in a fixed position on, for example, a piece of paper for creating a circle of even diameter depending on the distance between the legs 102,104. The creation of a circle and use of the compass 100 is well-known in the art and will not be further described herein.

The sleeve 116 of the present invention is slidably attached to the leg 104 and may be positioned to advance to an extended position to cover the pointed end 108 when the compass 100 is not in use. The embodiment shown in FIG. 4 includes a groove 128 in the sleeve 116 with perpendicularly extending grooves 132 integrally formed therewith. The leg 104 is shown having a button 130 extending therefrom for locking within the perpendicularly extending groove 132. Preferably, a spring 124 is provided that forces the sleeve 116 into the protected position when not in use. In addition, the button 130 may be depressable into the leg 104 such that the sleeve 116 may completely extend over the pointed end 108 of the leg 104 of the compass 100.

Alternatively, the groove 128 may be lengthened such that the button 130 does not interfere with complete extension of the sleeve 116 over the pointed end 108 when not in use. While the groove 128 with perpendicularly extending grooves 132 is shown and illustrated with reference to FIG. 4, it should be understood that a similar embodiment for the sleeve 116 to FIG. 2 without perpendicularly extending grooves and without a button 130 may also be implemented. Likewise, an embodiment without grooves and similar to FIG. 1 of the present invention may also be incorporated for the sleeve 116 of the present invention.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A retractable push pin assembly comprising:

a pin having a first end and a second end defining a length therebetween wherein the second end has a pointed tip;

an integrally formed sleeve having a first position, a second position and an interior space secured along the length of the pin such that the sleeve may extend between the first position and the second position such that the sleeve and the pin move relative to each other wherein the second position encloses the pointed tip within the interior space of the sleeve such that the length of the pin within the interior space; and a spring in the interior space of the sleeve holding the sleeve in the second position.

2. The assembly of claim 1 further comprising:

a longitudinal groove extending in a wall of the sleeve from a first end to a point toward a second end of the sleeve.

3. The assembly of claim 1 further comprising:

a collar associated with the pin intermediate the first end and the second end wherein the collar is in the interior space of the sleeve.

4. The assembly of claim 1 further comprising:

an aperture at each end of the sleeve cooperating with the pin.

5. The assembly of claim 1 further comprising:

a groove extending longitudinally along a length of the sleeve and further including a portion angularly disposed with respect to a longitudinal portion of the groove.

6. The assembly of claim 5 further comprising:

a button associated with the pin that is extendable in the groove of the sleeve.

7. The assembly of claim 1 further comprising:

first and second grooves peripherally displaced on the sleeve and extending in parallel and longitudinally along a length of the sleeve.

8. A retractable sleeve comprising:

a pin having a first end and a second end defining a length therebetween wherein the second end has a pointed tip;

an integral body having a length defined by walls wherein the walls define an interior space wherein the length of the integral body is greater than the length of the pin and further wherein the length of the body is defined between a first end and a second end;

a first aperture having a diameter at the first end of the integral body;

a second aperture having a diameter smaller than the diameter of the first aperture at the second end of the integral body; and a spring in the interior space of the integral body.

9. The sleeve of claim 8 further comprising:

a groove in the walls of the body longitudinally extending between the first end and the second end.

10. The sleeve of claim 8 further comprising:

a groove in the walls of the body longitudinally extending between the first end and the second end and further extending at an angle.

11. The sleeve of claim 8 wherein the body surrounds a point of an instrument.

* * * * *